United States Patent [19]

Hodges

[11] 4,025,071

[45] May 24, 1977

[54] TENNIS BALL SERVER AND COURT INSTALLATION

[76] Inventor: Kenneth M. Hodges, 3750 Grandview Blvd., Los Angeles, Calif. 90066

[22] Filed: Mar. 5, 1976

[21] Appl. No.: 664,376

[52] U.S. Cl. ..... 273/29 A; 124/51 R; 124/78; 124/82; 198/677

[51] Int. Cl.[2] ..... A63B 61/00

[58] Field of Search ..... 273/29 A, 30, 26 R, 273/26 D, 176 E, 176 G, 176 H, 201, 31; 124/10, 78, 80, 82, 53, 81, 51 R, 45, 48; 198/677; 272/3

[56] References Cited

UNITED STATES PATENTS

| | | | |
|---|---|---|---|
| 3,183 | 11/1868 | Williams | 198/677 |
| 349,390 | 9/1886 | Gilbert et al. | 198/677 X |
| 1,211,738 | 1/1917 | Marty | 124/78 X |
| 2,566,379 | 9/1951 | Strong | 124/78 X |
| 3,794,011 | 2/1974 | Newgarten | 124/78 |

*Primary Examiner*—Richard C. Pinkham
*Assistant Examiner*—T. Brown

[57] ABSTRACT

A tennis ball feeder and server characterized by a cooperating helical screw type ball feed and a rotating inertia wheel. The feed screw is positioned to revolve on a horizontal axis between a pair of spaced apart, upstanding rails which define an opening through which tennis balls pass to be advanced to the server by the feed screw. The feed screw is formed of a helical rod supported on radial spokes projecting from a horizontally disposed drive shaft. The inertia wheel is supported over a ball engaging rail in alignment with the longitudinal axis of the feed screw and adjacent one end thereof such that when a ball is advanced by the feed screw to an entrance end of the rail it will be wedged between the rail and inertia wheel to be propelled from the exit end of the rail.

7 Claims, 8 Drawing Figures

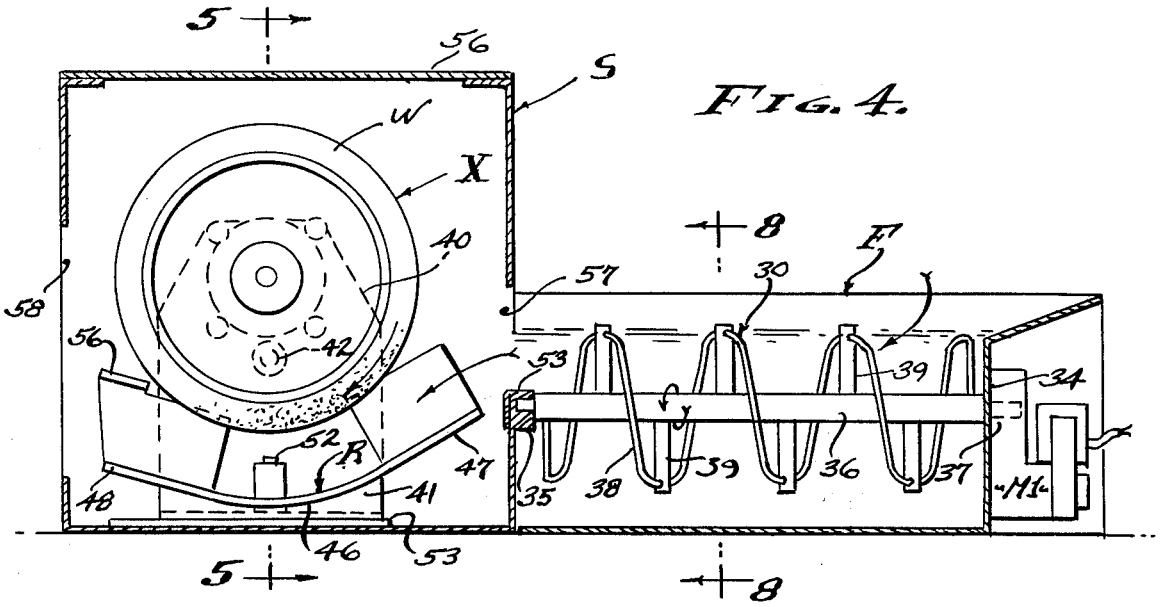
FIG. 4.
FIG. 5.
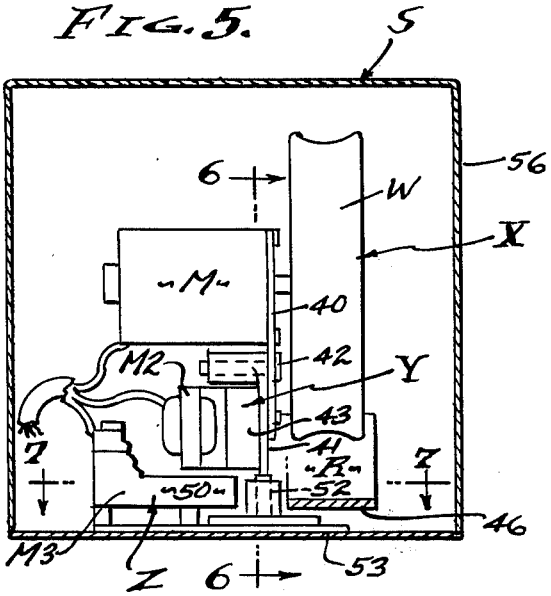
FIG. 8.
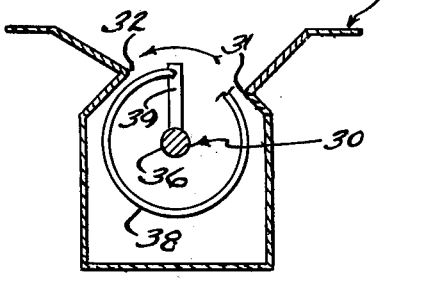
FIG. 6.
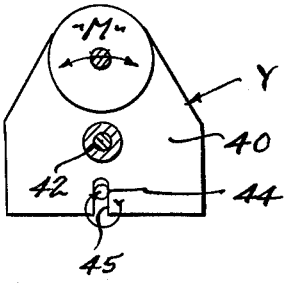
FIG. 7.
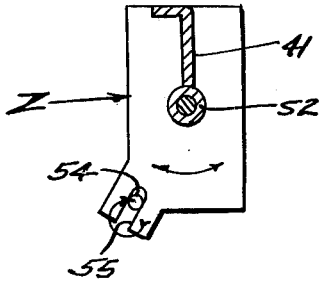

TENNIS BALL SERVER AND COURT INSTALLATION

BACKGROUND

Tennis alleys or lanes are operated for player practice and the improvement of their game, with the objective of realistic ball delivery and efficient recovery of balls returned by the player. Prior art machines and installations for this purpose have been complex and cumbersome, they have required the storage of a large supply of balls, the acceleration means have been detrimental to ball life, and the automatic simulation of serve variations has not been altogether realistic. Therefore, it is a general object of this invention to realistically serve a small supply of tennis balls, delivering all worn balls substantially the same as new live balls, delivering said balls through a true ground stroke trajectory, and recycling all balls returned to the net.

The cost of operating full tennis courts is more than double that of half-courts; due to the added labor in retrieving balls and investment inventory in a large number of balls. Therefore, it is the half-court with which this invention is particularly concerned, or practice alleys where the player has an opportunity to develope good strokes, good footwork, and good habits by which he can correct and improve his game; or to warm-up before actual play, or simply to develope natural playing ability. To these ends it is an object of this invention to provide a tennis ball server and pick-up system that recycles a small supply of tennis balls, all without alteration to the tennis court or alley floor. With the present invention, there are no pits to dig and/or no downslope required, and elevated structures are avoided; a characteristic feature of the present invention being to serve the ball from beneath the net with moderate overspin and at a speed establishing a trajectory that permits the player to track the ball during the half-court journey; recognizing that the player reaction time is half that for a full court. In this manner the ball stays within the base line of the court to rebound in the manner of a natural serve.

High speed balls are emitted with substantial top spin so as to have a retarding effect on the rebound and which produces a rather "heavy" realistic ball at the base line of the court to challenge the experienced player. Conversely, the server can be adjusted to deliver a relatively slow low spin ball which is readily handled by the beginner, but with full court feel. In actual practice, for example, few players introduced to this server comment at all on the emission of balls from below the net, except upon the initial encounter; and it is this "below the net installation" of the server and controlled trajectory thereby within the base line that is most practical and characteristic of this invention.

There is a practical limit to how narrow or how wide a practice lane or alley can be, 12 feet being a minimum and 24 feet a practical maximum. Because of the cover texture on tennis balls, they resist rolling and require a slope ratio of about one to five, particularly when they group or bunch up. Consequently a minimum lane width is to be desired in order to reduce the rise from the court center to either side thereof which determines the transverse ball run elevation. Furthermore, an inclined berm is provided to receive ground balls having sufficient velocity to climb into the said ball run for retrieval. Although the berm ramp is at a substantial incline, the ball run inclines are minimized (1–5) and all of which remains below the net and/or partially receives the lower margin of the net, as shown. It is an object therefore to provide an installation that retrieves tennis balls to the center of the net, and a server that emitts these tennis balls from below the net.

Balls that are retrieved by the player and which properly pass over the net are stopped in the normal manner by a damping net in the form of a back drop that depends below the top of the playing net and over the transverse ball runs. In this way, all tennis balls that pass over the net or up and over the berm ramp become retrieved balls, and in practice the percentage of these balls is high with respect to the ability of the player.

The sequence of serve and the placement of rebound at the base line is unique with the present invention. Heretofore, programming for such purposes has been stereotyped and/or inflexible with respect to timing, trajectory, and direction. With the present invention these factors of time, trajectory, and direction are dissimilar so as to produce an unpredictable sequence of serve, not following a determinable pattern but rather a random sequence of indeterminable character. As will be described, the three factors are motor controlled and each functioning on a time base disassociated with the frequencies of the others. Consequently, there is no detectable serve pattern, since the phase proximity of the three dissimilar frequencies is unpredictable as a practical matter.

SUMMARY OF INVENTION

This invention relates to tennis training and especially to courts (full courts and half courts) and to alleys or lanes automated to serve and to retrieve tennis balls that are properly intercepted and returned by the player. A feature of this invention is the emission of balls at variable velocity from below the playing net with random variations in elevation and traverse. Efficient ball retrieval is an objective, accomplished by a low berm disposed beneath the net and over which the return balls pass either over or below the net, including net balls that will normally drop behind the berm. The berm provides a ramp that ascends toward the net to an elevation coincidental with the outward reaches of opposite ball runs that descend from the sides of the court or lane to the center thereof, transversely and/or beneath the playing net. A feature of the invention is the ball feeder means and server means installed within the confines of the berm to recycle tennis balls that gravitate to the feeder to be dispensed into the server at a uniform rate. The server operates to spot the ball serves at random, as a function of dissimilar phase operation of elevation and traverse means and both of which operate out of phase with respect to the feeder means. The operative means are modified as by electrical motors, the feeder means and emitter of the server means being operable at variable speeds.

DRAWINGS

The various objects and features of this invention will be fully understood from the following detailed description of the typical preferred form and application thereof, throughout which description reference is made to the accompanying drawings, in which:

FIG. 4 is a longitudinal sectional view of the feeder means and server disposed as shown in FIG. 1.

FIG. 5 is an elevational sectional view taken as indicated by line 5—5 on FIG. 6.

Figure 1:
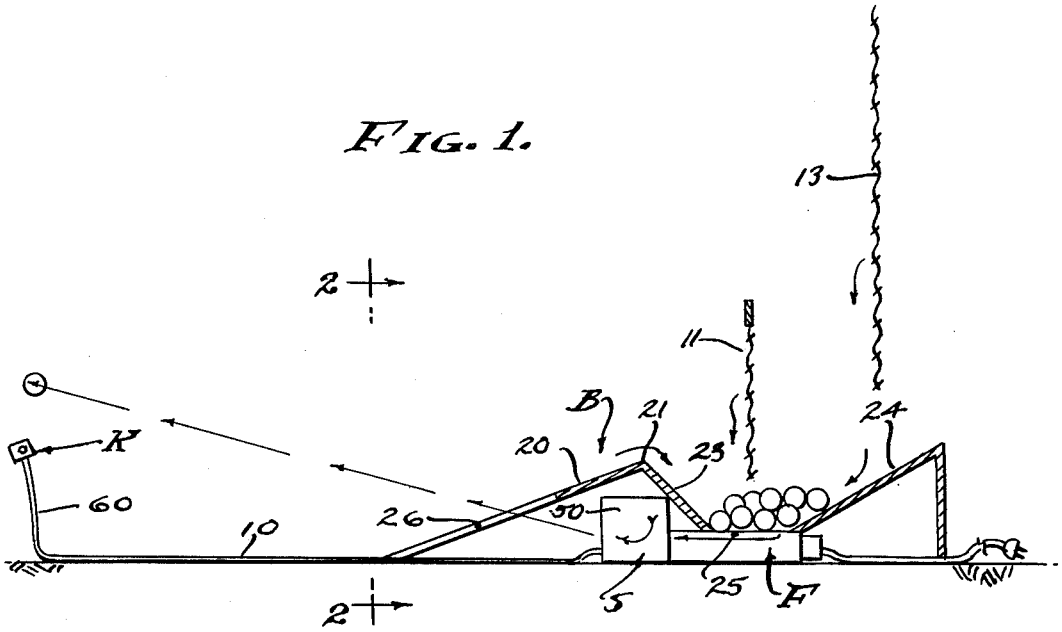
FIG. 1 is a longitudinal sectional view taken through the ball server and court installation.
Figure 2:
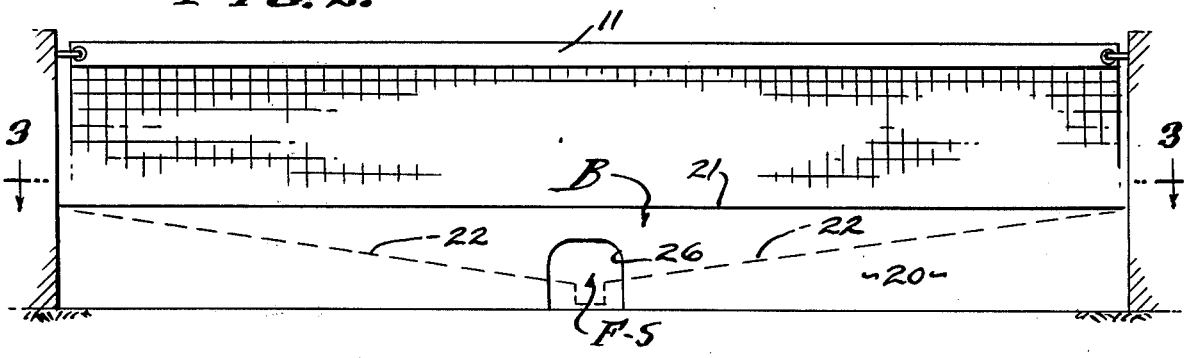
FIG. 2 is a transverse sectional view of the court installation taken as indicated by line 2—2 on FIG. 1.
Figure 3:
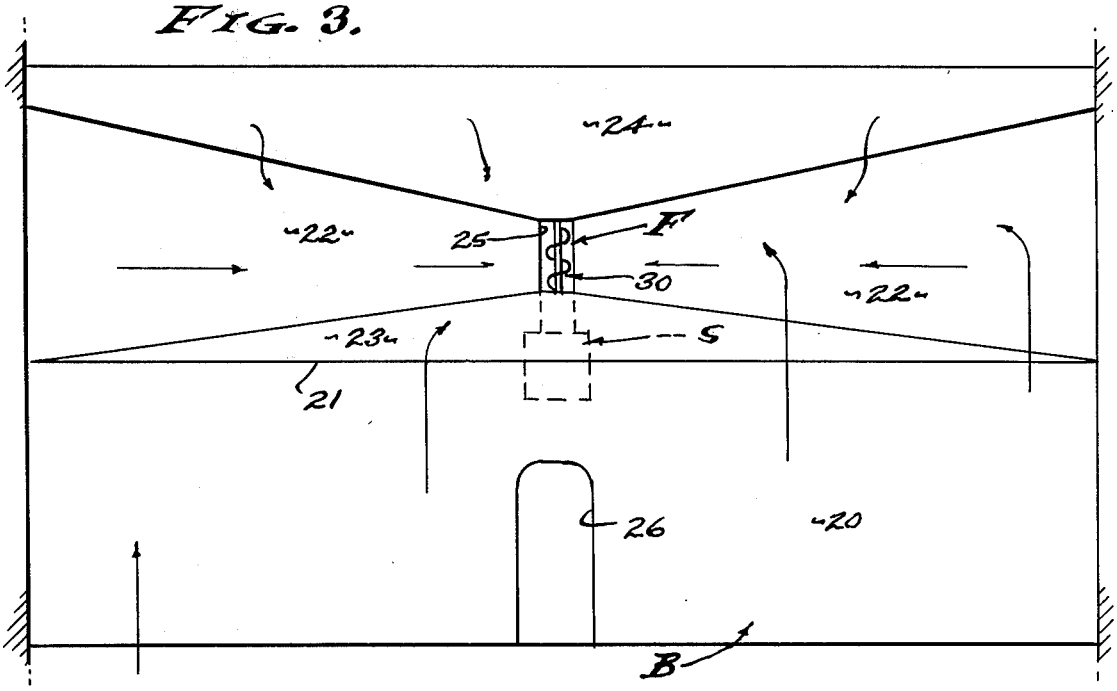
FIG. 3 is a plan view taken as indicated by line 3—3 on FIG. 2.

FIGS. 6 and 7 are fragmentary sectional views taken as indicated by lines 6—6 and 7—7 on FIG. 5, and FIG. 8 is a sectional view taken as indicated by line 8—8 on FIG. 4.

PREFERRED EMBODIMENT

Referring now to the drawings, the tennis court can be a full or half court, and preferably the latter which advantageously employs "under the net" emission of balls. Therefore, this ball server and retrieval installation is shown and described herein as related to a half court, alley or lane, wherein the floor or deck surface is not altered in any way, the server being incorporated in a berm that is disposed beneath the net to retrieve all balls returned to the net, whether they pass over or beneath or into the net. Accordingly, this invention involves, generally, a berm B with transverse ball runs descending to the center of the court or lane and a feeder means F and server S supplied by the feeder means and housed within the berm, the server being comprised of a ball emitter X, elevation means Y, and traverse means Z. The means E, X, Y, and Z are motivated as by electrical motors energized simultaneously to automatically serve and retrieve the tennis balls returned by the player.

The tennis court or lane is a flat horizontal rectangular surface 10 with a net 11 stretched transversely thereof mid-way of a full court or at one end of a half court or lane. The top of the net is usually 38 inches above the surface 10 and depends within 14 to 15 inches thereof, having a top margin that is taught with a depending mesh that is loose and adapted to damp the travel of low balls striking thereagainst. Behind the net 11 and extending to a substantial height is a damping net 13 that presents a loose mesh to damp the travel of high balls striking thereagainst. The base line (not shown) behind which the balls are spotted for rebound is a transverse line 15 feet from the net and parallel thereto. The court or lane may or may not have a center line (not shown).

Referring now to the server installation, the berm B extends coextensively with the net 11 and comprises a planar ramp 20 that ascends from the court surface 10 to an elevation approximating the lower margin of the net, and terminating in a ridge 21 spaced forward from and parallel to the net. In practice, the ascension angle of the ramp is about 20°. Behind the ramp 20 and descending from the ridge 21 there is a front drop panel 23 that is planar and extends from said ridge to the ball runs 22 next to be described; and descending from behind the aforementioned damping net 13 there is a back drop panel 24 that is planar and also extends to the said ball runs. In practice, the descension angle of the front and back drop panels 23 and 24 is about 30°. The ramp and drop members 20, 23, and 24 are parallel transverse members and each coextensive with the width of the court or lane and the net 11.

The ball runs 22 descend from a maximum elevation at the side extremities of the court, or lane and of the berm B, and extend to the center of the net 11 and an opening 25 adapted to drop one or more balls by gravity therethrough. The descent angle of the ball runs 22 is about one to five (as shown) and the centered opening 25 is about 5 inches about the surface 10. It will be apparent that balls returned by the player will be damped by net 11 or 13, or will pass over the ridge 21 to drop onto the ball runs 22 in order to gravitate to the opening 25.

The feeder means F and server S are cooperatively installed within the confines of the berm B beneath the opening 25, there being an emitter window 26 in the forwardly facing ramp 20 for the emission of balls served immediate to the court surface 10. In practice, the feeder means F and server S are cooperatively mated units, the former a low profile device disposed on a transport axis normal to the transverse berm B, and the latter a higher profile device, and both of which are housed within the confines of the said berm. In accordance with this invention, the feeder means F is a motorized screw means and the server S is a motorized emission means, each dependent upon the other and operating at a dissimilar rate (phase) relative to each other. Each unit (F and S) is self-contained within its housing to contain its motivating means, and secured one to the other by fastener means in the relationship shown, the feeder means F underlying the opening 25 and the server means S disposed behind the window 26.

The feeder means F comprises a screw 30 revolving on a horizontal axis between a pair of assymetrically positioned and spaced rails 31 and 32, and on bearings carried by front and rear headers 33 and 34. Since the berm and ball runs are said to be disposed transversely, then the axis of the screw 30 is longitudinally disposed in line with the center of the court or lane, the spaced rails 31 and 32 framing the opening 25 and in practice fastened to the inner terminal ends of the ball runs respectively. The rails 31 and 32 are preferably parts of a U-shaped housing four to five inches square in cross section, with the front header 33 hooked to the server means S and having a bearing 35 carrying a horizontal screw shaft 36, and with the rear header 34 in the form of a bulkhead mounting a gear-head motor M1 and gear drive 37 with bearings carrying the screw shaft 36.

Viewed from its forward end, the screw 30 and shaft 36 revolve clockwise, the screw being formed of a right-hand helical rod 38 supported on radial spokes 39 projecting from the shaft 36. In practice, the helical rod 38 is of ⅛ inch diameter and disposed at a 1 ¾ inch radius (a 3 ½ inch diameter screw) around the shaft 36 of ⅝ inch diameter, and the pitch of the helic uniformly spaced at 3 ¾ inch. The screw 30 is coextensive with the length of the opening 25, approximately 1 foot long as shown so as to receive the tennis balls that bunch-up and drop by gravity into and throughout the length of the opening 25 defined by the assymetrical rails 31 and 32. In accordance with this invention the rails are parallel with the screw 30 and spaced radially from the peripheral rod 38 approximately ⅜ inch, a drop rail 31 and a stop rail 32. The said drop rail 31 is positioned counterclockwise as related to the direction of rotation, while the said stop rail 32 is positioned clockwise thereto, rail 31 being at a height disposed approximately ¾ inch below the top center of the peripheral rod 38 of the screw, and rail 32 being at a height disposed approximately equal and/or slightly below the top center height of said peripheral rod 38 of the screw.

The aforesaid dimensional relationships are most satisfactory with tennis balls that are of a normal 2.6 inch diameter, it being significant that there is a height differential between the two rails 31 and 32 that prevents bridging of two or more tennis balls, and to the end that the balls are assured of leaving the drop rail 31 to fall by gravity onto the shaft 36 to be centered below the helical rod 38. In operation the tennis balls drop within the pitch spacing of the rod 38 and ride upon the shaft 36 to be advanced thereby and captured below the stop rail 32 which is disposed in a plane above the centers of the balls supported upon said shaft. Motor M1 and gear drive 37 operates screw 30 at the rate of 15 revolutions or cycles per minute and thereby feeds a ball to the server S at the rate of one every four seconds, or 840 in one period of operation. As will be described, the server S emits 840 balls in one 56 minute period without repeating the placement of a serve.

The server S is comprised of the ball emitter X articulately motivated to automatically vary the elevation and traverse by the means Y and Z respectively. To this end, the elevation means Y and Z are cooperatively combined to form a turret that moveably mounts the ball emitter X, the latter comprising an inertia wheel W and a rail R opposed to the periphery of said wheel to receive and drive balls engaged therebetween. The inertia wheel W is driven by a variable speed motor M, on the extended shaft thereof disposed on a horizontal axis. The wheel W is tyred with an elastomer surface and is slightly concaved, with an outside diameter of approximately 8 inches and revolved by motor M at speeds of about 5000 RPM. As shown, the motor M and wheel W are carried upon a vertically disposed oscillating plate 40 disposed in a fore and aft plane normal to the rotational axis of said motor and wheel, the plate 40 being positionably mounted upon a stand 41 on an axis below and parallel to the motor and wheel axis by a horizontal pivot 42 and motorized by said motor to vary the elevation.

Referring now to the elevation means Y, the rail R is carried by the plate 40 so as to clear the lowermost space limit of the server S, said rail comprising a drive section 46 concentric with the wheel W throughout an arc of approximately 45°, and with exit and entry portions 47 and 48 extended tangentially therefrom approximately 3 inches, respectively. Section 46 is spaced approximately 2 inches radially from the periphery of wheel W so as to compress the tennis balls which are normally 2.6 inches in diameter. As shown, the stand 41 is vertically disposed adjacently behind (with respect to wheel W) the plate 40 and mounts a gear-head motor M2 and gear drive 43 with an eccentric crank 44 (see FIG. 6) engaged in a vertically disposed drive slot 45 in plate 40 below the pivot 42. In practice, the plate is oscillated through an arc of approximately 10° by revolvement of said crank 44, and correspondingly varies the elevation of the emitter X. In accordance with the invention, this rate of oscillation is eight cycles per minute which is out of phase with the aforesaid feed cycle of 15 balls per minute, and to the end that an identical phase relationship therebetween occurs every 120 cycles or every 8 minutes.

Referring now to the traverse means Z, the stand 41 is positionably mounted to a base 51 by a vertical pivot 52 and motorized by a motor M3 to vary the traverse position of the machine. As shown, the stand 41 is affixed to a platform 53 with the pivot closely adjacent to the stand and plate 40 and preferably in the vertical plane of the axis of motor M1 and wheel W. The motor M3 and its gear drive 50 revolves an eccentric crank 54 (see FIG. 7) engaged in a slot 55 in the platform and disposed radially to said pivot 52, so as to oscillate the platform and stand through an arc of 10°, and thereby varies the traverse position of the emitter X. In accordance with the invention, this rate of oscillation is seven cycles per minute which is out of phase with each of the aforesaid freed and elevation cycles of 15 and 8 cycles per minute, respectively, and all to the end that an identical phase relation therebetween occurs every 840 cycles or every 56 minutes.

The server S with its emitter X, elevation means Y and traverse means Z is accommodated within a housing 56 having a ball feed port 57 and an emitter port 58. Thus, the operative mechanism is protectively enclosed, there being a guard 56 adjacent the wheel W that moves with the rail R and plate 40 and positioned thereby above the ball trajectory to protect against the hazards of the fast moving wheel. In carrying out the invention, there is a speed control K for the motor M so as to adjust the velocity of the serve, and this control K can be located at the housing or remoted by cable 60 as indicated. It is thereby understood that motor M1, M2, and/or M3 can be individually or jointly adjustable to vary the cycles of operation.

From the foregoing it will be seen that a relatively few number of balls is required to supply this tennis ball server and court installation, depending of course upon the return capability of the player. In this respect, every ball that goes over the net, or strikes the net, or passes up and over the berm is recycled by the feeder within sixteen seconds after its drop through the feeder opening 25. A feature of this invention is the simplicity of the feed mechanism that involves the ball port 57 that separates the feeder means F and server means S to ensure continuity of operation. That is, as the feed screw 30 advances the tennis balls, the helical rod 38 and stop rail 32 positioned higher from shaft 36 than the ball centers ensures downward capture of said balls and the consequent delivery from the feeder and through the port 57 sized so as to freely pass said balls. Subsequently, the balls are then individually engaged by the wheel W when dropped onto the declined entry portion 48 of the rail R, to be driven forwardly and emitted on a trajectory determined by the means Y and Z. As stated hereinabove, the placement and/or spotting of the ball serves is repeated every 840 cycles or every 56 minutes, a programming that cannot be anticipated as a practical matter by the player and which in effect produces random serves.

Spokes 49 of the feeder means F project from rod 38 so as to continually tumble and circulate balls, eliminating jamming and mass bunching of balls. There is complete recovery of all balls hit to the net, and immediate and complete recycling of those balls. As a result, the installation functions adequately with only 12 to 17 balls, even when allowing for up to 10 balls on the court which do not reach the net.

Having described only a typical preferred form and application of my invention, I do not wish to be limited or restricted to the specific details herein set forth, but wish to reserve to myself any modifications or variations that may appear to those skilled in the art:

I claim:

1. In combination, a tennis ball feeder and server for tennis practice court installation: the feeder including a feed screw disposed below an opening through which conventional tennis balls pass and being disposed on an axis aligned with the direction in which the balls are served by said server, said feed screw having a predetermined radius and being comprised of a center shaft to support said conventional tennis balls advancing and a helical rod having a radius greater than that of said balls, a pair of upstanding spaced apart and parallel rails enclosing said feed screw, one of said rails being positioned counterclockwise and the other being positioned clockwise as related to the direction of feed screw rotation, said rails being disposed relative to each other a distance greater than said predetermined radius of the feed screw, and drive means motivating the feed screw to revolve clockwise, the feed screw being of right hand pitch to engage balls dropped through said opening defined by said spaced apart rails to advance the same along said shaft thereof; the server including an inertia wheel supported on a transverse axis overlying a rail concentric therewith and aligned with the said feed screw to receive balls delivered sequentially therefrom, to engage said balls said rail having entry and exit portions extended tangentially therefrom to receive and to emit said balls upon engagement by said wheel.

2. The feeder and server combination as set forth in claim 1, wherein the heliccal rod of the feed screw is supported by spokes projected radially from the center shaft.

3. The feeder and server combination as set forth in claim 1, wherein the helical rod of the feed screw is supported by diametrically opposite spokes projected radially from the center shaft.

4. The feeder and server combination as set forth in claim 1, wherein the helical rod of the feed screw is supported by spokes projected radially from the center shaft and projecting radially from said helical rod for agitation of the said balls.

5. The feeder and server combination as set forth in claim 1, wherein the helical rod of the feed screw is supported by diametrically opposite spokes projected radially from the center shaft and projecting radially from said helical rod for agitation of the said balls.

6. The feeder and server combination as set forth in claim 1, wherein one of said spaced rails is positioned at a height substantially below the perimeter of the screw.

7. The feeder and server combination as set forth in claim 1, wherein a ball feed port freely passes said balls is disposed between the feeder and server.

* * * * *